US009386816B2

(12) United States Patent
Underwood et al.

(10) Patent No.: US 9,386,816 B2
(45) Date of Patent: Jul. 12, 2016

(54) FIRE RESISTANT GARMENTS CONTAINING A HIGH LUBRICITY THERMAL LINER

(75) Inventors: Joey K. Underwood, Greenville, SC (US); Jacques A. Cantin, Greenville, SC (US); Guy Connors Lucas, Charlotte, NC (US)

(73) Assignee: INTERNATIONAL TEXTILE GROUP, INC., Greensboro, NC (US)

( * ) Notice: Subject to any disclaimer, the term of this patent is extended or adjusted under 35 U.S.C. 154(b) by 818 days.

(21) Appl. No.: 13/396,125

(22) Filed: Feb. 14, 2012

(65) Prior Publication Data

US 2013/0205481 A1 Aug. 15, 2013

(51) Int. Cl.

| | |
|---|---|
| ***D03D 15/00*** | (2006.01) |
| ***A62D 5/00*** | (2006.01) |
| ***A41D 1/00*** | (2006.01) |
| ***A41D 3/02*** | (2006.01) |
| ***A62B 17/00*** | (2006.01) |
| ***A41D 27/02*** | (2006.01) |
| ***D03D 15/12*** | (2006.01) |
| ***A41D 27/04*** | (2006.01) |
| ***A41D 31/00*** | (2006.01) |

(52) U.S. Cl.

CPC ..... *A41D 27/02* (2013.01); *A41D 27/04* (2013.01); *A41D 31/0022* (2013.01); *D03D 15/12* (2013.01); *A41D 2500/00* (2013.01)

(58) Field of Classification Search

CPC . Y10S 428/92; Y10S 428/921; Y10S 57/904; A62B 17/00; A62B 17/001; A62B 17/003; D10B 2331/021; D10B 2501/04; A41D 31/0027; A41D 31/0022; A41D 31/0033; A41D 31/0038; A41D 31/02; A41D 27/02; D03D 15/00; D03D 15/12

See application file for complete search history.

(56) References Cited

U.S. PATENT DOCUMENTS

| | | | | |
|---|---|---|---|---|
| 2,333,824 | A | 11/1943 | Shoepf | |
| 2,696,723 | A | 12/1954 | Fritht, Jr. | |
| 3,019,821 | A * | 2/1962 | White | 139/420 R |
| 3,097,442 | A | 7/1963 | Willingham, Jr. | |
| 3,710,395 | A | 1/1973 | Spano et al. | |
| 3,806,959 | A | 4/1974 | Gross | |
| 4,034,417 | A | 7/1977 | Ellis | |
| 4,039,709 | A | 8/1977 | Newman | |
| 4,451,934 | A | 6/1984 | Giollo | |
| 4,502,153 | A | 3/1985 | Lapedes et al. | |

(Continued)

FOREIGN PATENT DOCUMENTS

| | | |
|---|---|---|
| AU | 2005200963 | 3/2005 |
| DE | 202010011193 | 9/2010 |

(Continued)

*Primary Examiner* — Alissa L Hoey
*Assistant Examiner* — Jameson Collier
(74) *Attorney, Agent, or Firm* — Dority & Manning, PA

(57) ABSTRACT

Protective garments are disclosed having an inner lining with high lubricity and high strength characteristics. The inner lining, in one embodiment, contains spun yarns combined with para-aramid multifilament yarns. The spun yarns may also contain flame resistant fibers, such as meta-aramid fibers, FR cellulose fibers, or mixtures thereof. The para-aramid filament yarns provide excellent strength characteristics to the fabric. In addition, in some embodiments, the multifilament yarns may enhance the fire resistant properties of the fabric. In one embodiment, the para-aramid filament yarns may have less than five twists per inch, such as from about 1 twist per inch to about four twists per inch.

24 Claims, 5 Drawing Sheets

(56) References Cited

U.S. PATENT DOCUMENTS 4,604,759 A 8/1986 Bowman et al.
4,615,934 A 10/1986 Ellison
4,668,234 A 5/1987 Vance et al.
4,709,421 A 12/1987 Grilliot et al.
4,748,691 A 6/1988 Grilliot et al.
4,830,897 A 5/1989 Lichenstein
4,843,646 A 7/1989 Grilliot et al.
4,865,906 A * 9/1989 Smith, Jr. ..... 442/197
4,897,886 A 2/1990 Grilliot et al.
4,920,000 A 4/1990 Green
5,001,781 A 3/1991 Grilliot et al.
5,001,783 A 3/1991 Grilliot et al.
5,031,242 A 7/1991 Aldridge et al.
5,127,106 A * 7/1992 Aldridge ..... 2/81
5,131,097 A 7/1992 Grilliot et al.
5,136,723 A 8/1992 Aldridge et al.
5,141,542 A 8/1992 Fangeat et al.
5,150,476 A 9/1992 Statham et al.
5,236,769 A 8/1993 Paire
5,299,602 A 4/1994 Barbeau et al.
5,323,815 A 6/1994 Barbeau et al.
5,362,555 A 11/1994 Lal
5,499,663 A * 3/1996 Barbeau et al. ..... 139/420 A
5,527,597 A 6/1996 Stanhope et al.
5,539,928 A 7/1996 Aldridge
5,640,718 A 6/1997 Aldridge
5,685,015 A 11/1997 Aldridge
5,691,040 A 11/1997 Barbeau et al.
5,694,981 A 12/1997 Stanhope et al.
5,724,673 A 3/1998 Aldridge
5,727,401 A 3/1998 Statham
5,819,316 A 10/1998 Aldridge
5,824,614 A 10/1998 Gadoury et al.
5,830,319 A 11/1998 Landin
5,830,574 A 11/1998 Gadoury
5,849,648 A 12/1998 Kent et al.
5,858,888 A 1/1999 Underwood et al.
5,860,163 A 1/1999 Aldridge
5,885,307 A 3/1999 Gadoury
5,891,813 A 4/1999 Gadoury
5,920,905 A 7/1999 Aldridge
5,928,971 A † 7/1999 Ellis
6,065,153 A * 5/2000 Underwood et al. ..... 2/93
6,132,476 A 10/2000 Lunsford et al.
6,192,520 B1 * 2/2001 Underwood et al. ..... 2/93
6,247,179 B1 † 6/2001 Underwood
6,341,384 B1 1/2002 Hayes
6,397,401 B2 6/2002 Belcher
6,430,754 B1 8/2002 Taylor et al.
6,547,835 B1 4/2003 Lunsford et al.
6,602,600 B2 8/2003 Zhu
6,626,964 B1 9/2003 Lunsford et al.
6,668,868 B2 12/2003 Howland et al.
6,693,052 B2 2/2004 Howland
6,699,802 B1 * 3/2004 Hainsworth et al. ..... 442/2
6,735,789 B2 5/2004 Kelleher et al.
6,818,024 B2 11/2004 Lunsford et al.
6,840,288 B2 1/2005 Zhu et al.
6,861,378 B2 3/2005 Cunningham
6,867,154 B1 3/2005 Lunsford et al.
6,955,193 B2 * 10/2005 Hainsworth et al. ..... 139/426 R
6,974,785 B1 † 12/2005 Barbeau
6,983,490 B1 * 1/2006 Lewis et al. ..... 2/97
7,013,496 B2 3/2006 Dunn
7,065,950 B2 6/2006 Zhu et al.
7,073,538 B2 7/2006 Bhatnagar
7,156,883 B2 * 1/2007 Lovasic et al. ..... 8/115.51
7,284,398 B2 10/2007 Hubner
7,402,538 B2 7/2008 Bader et al.
7,589,036 B2 9/2009 Corner
7,634,819 B2 12/2009 Grey
7,676,855 B2 3/2010 Dunn
7,854,017 B2 12/2010 Laton
7,862,865 B2 1/2011 Truesdale, III et al.
RE42,209 E 3/2011 Lunsford
7,988,779 B2 8/2011 Disalvo et al.
7,993,415 B2 8/2011 Vogt et al.
8,017,532 B2 9/2011 Okada
8,063,116 B2 11/2011 Trogolo et al.
8,347,420 B2 1/2013 Kruszewski et al.
2001/0009832 A1 7/2001 Shaffer et al.
2002/0016985 A1 2/2002 Kelleher et al.
2002/0069453 A1 6/2002 Kelleher et al.
2003/0082972 A1 5/2003 Monfalcone, III et al.
2003/0167580 A1 9/2003 Lunsford et al.
2003/0190853 A1 10/2003 Lovingood
2003/0203690 A1 * 10/2003 Hess et al. ..... 442/181
2003/0226612 A1 12/2003 Zhu et al.
2003/0228812 A1 * 12/2003 Stanhope et al. ..... 442/49
2003/0232560 A1 12/2003 Corner
2004/0029473 A1 2/2004 McKee et al.
2004/0045103 A1 3/2004 Lunsford
2004/0065072 A1 4/2004 Zhu et al.
2004/0092187 A1 * 5/2004 Favier et al. ..... 442/203
2004/0152378 A1 * 8/2004 Stanhope et al. ..... 442/5
2004/0248494 A1 12/2004 Hartgrove et al.
2005/0025962 A1 * 2/2005 Zhu et al. ..... 428/359
2005/0032449 A1 2/2005 Lovasic et al.
2005/0037057 A1 * 2/2005 Schuette et al. ..... 424/443
2005/0050619 A1 * 3/2005 Dunn ..... 2/458
2005/0060820 A1 3/2005 Lunsford et al.
2005/0064020 A1 † 3/2005 Schuette
2005/0097652 A1 * 5/2005 Rock et al. ..... 2/82
2005/0221706 A1 * 10/2005 Bader et al. ..... 442/181
2005/0245163 A1 11/2005 Aneja et al.
2005/0287364 A1 12/2005 Zhu et al.
2006/0040575 A1 2/2006 Kelleher et al.
2006/0084337 A1 * 4/2006 Corner et al. ..... 442/203
2006/0143809 A1 7/2006 Dunn
2006/0160454 A1 * 7/2006 Handermann et al. ..... 442/415
2006/0264136 A1 11/2006 Chiantese
2007/0026752 A1 2/2007 Thiriot
2007/0123127 A1 * 5/2007 Hirschmann et al. ..... 442/136
2007/0137012 A1 * 6/2007 Laton ..... 28/167
2007/0184737 A1 8/2007 Corner et al.
2007/0224902 A1 * 9/2007 Hilleary et al. ..... 442/301
2007/0249250 A1 10/2007 Servajean
2008/0057807 A1 3/2008 Tutterow et al.
2008/0086798 A1 4/2008 Allen et al.
2008/0148468 A1 6/2008 Laton et al.
2008/0152888 A1 6/2008 Tutterow et al.
2008/0227352 A1 9/2008 Byles et al.
2008/0295232 A1 12/2008 Truesdale, III et al.
2009/0030111 A1 1/2009 Barnes et al.
2009/0139016 A1 6/2009 Zhu et al.
2009/0178186 A1 7/2009 Truesdale
2009/0226653 A1 9/2009 Harris et al.
2009/0255038 A1 † 10/2009 Curtis
2010/0024103 A1 2/2010 Kelleher et al.
2010/0075557 A1 3/2010 Shteiyer
2010/0112312 A1 5/2010 Tutterow et al.
2010/0143683 A1 6/2010 Chiou
2010/0297905 A1 * 11/2010 Ulrich et al. ..... 442/302
2011/0010827 A1 * 1/2011 Stanhope et al. ..... 2/458
2011/0023206 A1 † 2/2011 Dunn
2011/0138523 A1 6/2011 Layson, Jr. et al.
2011/0191949 A1 * 8/2011 Underwood et al. ..... 2/458
2011/0250810 A1 * 10/2011 Zhu ..... 442/199
2012/0031783 A1 2/2012 Fay, III et al.
2012/0090080 A1 4/2012 Stanhope et al.
2012/0183747 A1 7/2012 Bader
2012/0210481 A1 8/2012 Rock
2012/0270456 A1 * 10/2012 Gstettner et al. ..... 442/302
2013/0216810 A1 8/2013 Hines et al.
2013/0254980 A1 * 10/2013 Underwood et al. ..... 2/458

FOREIGN PATENT DOCUMENTS

WO WO 2007/061423 5/2007
WO WO 2010/091476 8/2010

* cited by examiner
† cited by third party

FIG. –1–

FIRE RESISTANT GARMENTS CONTAINING A HIGH LUBRICITY THERMAL LINER

BACKGROUND

Various different types of protective garments exist that are designed to protect the wearer in the environment in which the garment is worn. For instance, various protective garments exist that are intended to be fire resistant. Such garments are worn by military personnel, industrial workers, pilots, rescue personnel, and firefighters.

Firefighter garments, for instance, are intended to not only protect the firefighter from exposure to fires but are also designed to be water resistant. Firefighter garments typically include multiple layers of materials. For example, firefighter garments typically include an outer shell attached to an inner lining or face cloth. The firefighter garment may include intermediate layers, such as a moisture barrier layer and/or a thermal barrier layer. Each layer can be made from fire resistant materials, such as fire resistant fibers and yarns.

Many protective garments, such as firefighter garments, are intended not only to protect the wearer from fire and other elements, but the garments should also be comfortable to wear. For example, firefighter garments that do not provide water resistance may absorb water during use and increase in weight thereby increasing the load on the wearer.

The inner lining of protective garments as described above should also display high lubricity characteristics. A low friction inner lining, for instance, makes it much easier to don the garment and to take the garment off later. A low friction inner lining also can substantially increase the comfort of the garment during use, especially when the wearer is actively moving. Ultimately, a low friction inner lining can reduce the amount of stress imposed on the wearer, especially when worn in harsh environments.

In this regard, those skilled in the art in the past have attempted to produce inner linings for protective garments that are not only fire resistant but also have excellent lubricity characteristics. For example, inner linings made from multifilament yarns and spun yarns are disclosed in U.S. Pat. No. 6,247,179 and U.S. Pat. No. 5,858,888, which are both incorporated herein by reference. The inner linings disclosed in the above patents have provided great advancements in the art demonstrated by significant commercial success. U.S. Pat. No. 5,539,928 and U.S. Patent Publication No. 2009/0255038, which are also both incorporated herein by reference, also disclose inner liners having high lubricity characteristics.

The present disclosure is directed to further improvements in the construction of protective garments and particularly in the construction of high lubricity liners for protective garments.

SUMMARY

In general, the present disclosure is directed to protective garments having an inner lining with high lubricity and high strength characteristics. In one embodiment, the protective garment and the inner lining may be constructed so as to provide protection to a wearer against fires, open flames, incendiary devices, and the like.

In one embodiment, the protective garment includes an outer shell having an exterior surface and an inside surface. An inner lining is positioned on the inside surface of the outer shell. For instance, the inner lining can be directly affixed to the outer shell or may be attached to a garment subassembly that is then connected to the outer shell.

The inner lining comprises a woven fabric having first yarns and second yarns. The inner lining has an interior surface positioned to face a wearer and an opposite outside surface. The interior surface of the inner lining has greater lubricity characteristics than the outside surface. In accordance with the present disclosure, the first yarns used to produce the inner lining comprise spun yarns, while the second yarns comprise para-aramid filament yarns. The second yarns occupy a greater surface area than the first yarns on the interior surface and provide the inner lining with the desired lubricity characteristics. The filament yarns also provide strength to the inner lining. For instance, the fabric that comprises the inner lining may have a tensile strength in at least one direction according to ASTM Test D5034 of greater than about 400 pounds per foot$^2$ (lbsf), such as greater than about 450 lbsf, such as greater than about 500 lbsf, such as greater than about 550 lbsf, such as greater than about 600 lbsf.

The para-aramid filament yarns, in one embodiment, can have a denier of from about 100 to about 400. Of particular advantage, the filament yarns made from the para-aramid filaments may not need to be twisted prior to weaving the fabric. For instance, the second yarns contained in the inner lining may have less than about five twists per inch, such as less than about three twists per inch, such as even less than about one twist per inch. Reducing the number of twists per inch not only simplifies the manner in which the fabric is formed, but may also lead to improved properties in certain embodiments, such as improved fire resistant properties and improved lubricity properties.

The spun yarns contained within the inner lining may contain flame resistant fibers, such as inherently flame resistant fibers alone or in combination with cellulose fibers that have been treated with a flame retardant composition. In general, the inner lining can have a basis weight of from about 2 ounces per yard$^2$ (osy) to about 5 osy, such as from about 2.5 osy to about 4 osy. In one particular embodiment, the inner lining may comprise a fabric having a twill weave. The fabric can have from about 70 to about 90 ends per inch and from about 60 to about 80 picks per inch.

Inner linings made according to the present disclosure can have excellent flame resistant properties, even after being laundered. For instance, the inner lining may display a char length of less than about 40 mm, such as less than about 30 mm, such as even less than about 20 mm in at least one direction when tested according to ASTM Test D6413 and after being subjected to five laundry cycles.

In one embodiment, the inner lining can further be treated with an odor control agent. The odor control agent may comprise, for instance, a silver ion. In one embodiment, for instance, the odor control agent may comprise a silver zeolite.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
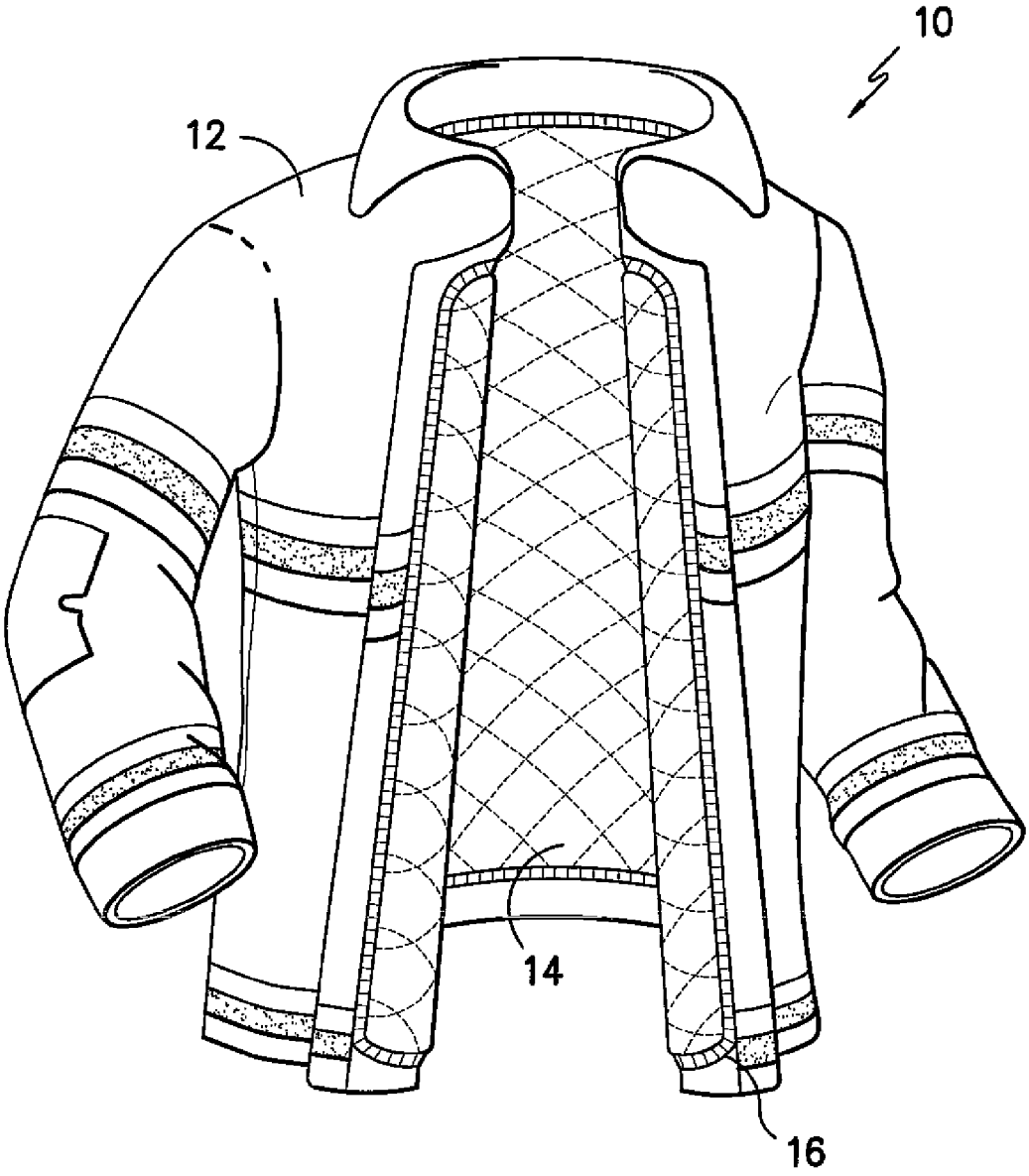
FIG. 1 is a perspective view of one embodiment of a protective garment made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to protective garments that include an inner liner. In one embodiment, the protective garment is flame resistant and thus protects the wearer from exposure to fire, including flash fires. In accordance with the present disclosure, the inner liner is not only flame resistant but also has high lubricity characteristics. In comparison to lining materials used in the past, the inner liner has improved strength properties and may also have improved fire resistant properties.

In general, the inner liner of the present disclosure is made from a woven fabric that includes at least two different types of yarns. The first yarn comprises a spun yarn that contains inherently fire resistant fibers, such as meta-aramid fibers. The second yarns, on the other hand, comprise multifilament yarns made from para-aramid filaments. The yarns are woven together so that the second yarns occupy a majority of the surface area on one surface of the fabric which forms an interior surface of the protective garment. The use of multifilament para-aramid yarns as the second yarns has been found to provide numerous advantages and benefits. Although para-aramid filaments are known to have good strength characteristics, the increase in strength of the fabric when using the para-aramid filament yarns is unexpectedly high in comparison to a similar fabric containing other types of filament yarns. For instance, the strength of the fabric can, in some applications, be twice as much as the strength of previous liner fabrics. In addition to strength characteristics, the fire resistant properties of the fabric may be significantly enhanced. In addition, it was discovered that when using multifilament yarns made from a para-aramid, the amount of twists placed into the yarn in order to weave the yarn may be minimized. In fact, in one embodiment, the fabric may be woven without having to twist the multifilament yarns. In the past, for instance, meta-aramid yarns were typically twisted prior to weaving. The yarns were twisted in order to prevent breakage. In accordance with the present disclosure, however, the para-aramid multifilament yarns may have a minimal amount of twists which not only simplifies the manufacturing process and saves labor costs, but also may enhance the fire resistant properties of the fabric or various other properties. In addition to the above advantages, the fabric of the present disclosure also produces garments having excellent seam strength.

FIG. 1 illustrates an improved protective garment 10 constructed in accordance with the present disclosure. Garment 10 includes a relatively tough outer shell 12 having a liner assembly 14 located therein. Outer shell 12 and liner assembly 14 together function to protect a wearer from heat and flame such as may be encountered during firefighting activities.

In the illustrated embodiment, liner assembly 14 is constructed as a separate unit that may be removed from outer shell 12. A zipper 16 is provided in this case to maintain liner assembly 14 in position within outer shell 12 as shown. It should be appreciated, however, that other suitable means of attachment, such as various hook and pile arrangements, may also be utilized for this purpose.

Figure 2:
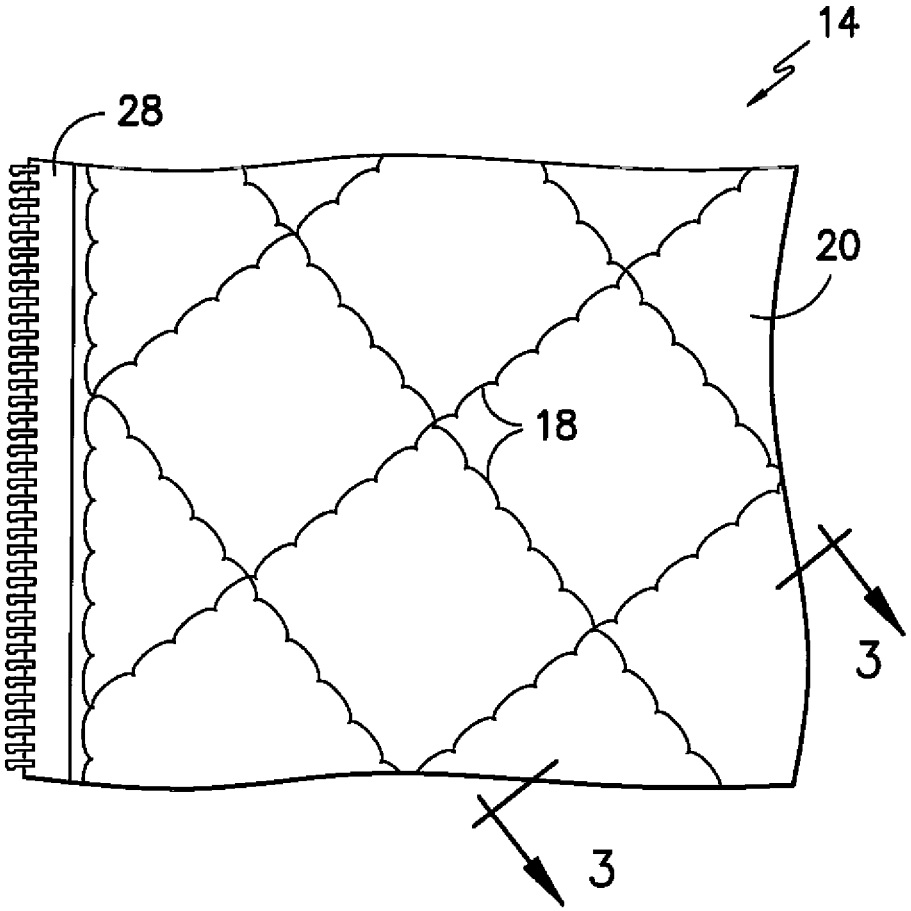
FIG. 2 is a plan view of one embodiment of an inner lining made in accordance with the present disclosure.
Figure 3:
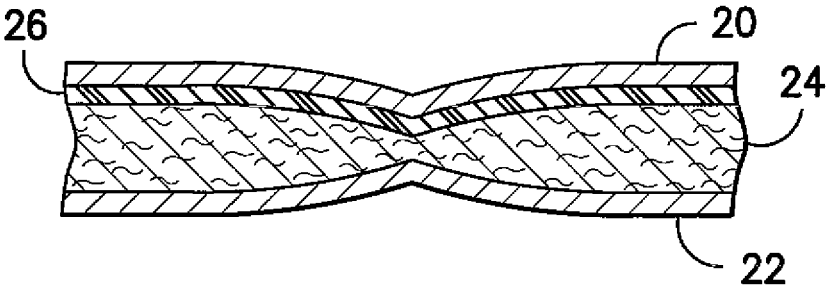
FIG. 3 is a cross-sectional view taken along lines 3-3 of FIG. 2.

The construction of liner assembly 14 may be most easily explained with reference to FIGS. 2 and 3. As can be seen, liner assembly 14 includes a plurality of material layers quilted together by crisscrossing stitch lines 18. The outermost layers, i.e., lining layers 20 and 22, are connected together about their respective peripheries to form an inner cavity. A thermal barrier layer 24 and a moisture barrier layer 26 are located within the inner cavity, as shown. The half of zipper 16 that remains connected to liner assembly 14 when removed is indicated at 28.

Typically, lining layer 20 will be adjacent the wearer's body during use, whereas lining layer 22 will be immediately inside of outer shell 12. As will be described more fully below, lining layers 20 and 22 are made from a textile material having a first side of higher lubricity and a second side of lesser lubricity. The higher lubricity sides are directed outwardly such that the outer surface of finer assembly 14 will be relatively "slick." This construction desirably reduces the friction that may otherwise be produced by rubbing against the wearer's clothing. Friction between the liner assembly 14 and outer shell 12 may also be reduced in this manner.

In the illustrated embodiment, an aramid felt, such as a felt produced from meta-aramid fibers, is utilized to provide thermal barrier layer 24. The felt functions as an insulator to inhibit transfer of heat from the ambient environment to the wearer.

Moisture barrier layer 26 is preferably a suitable polymeric membrane that is impermeable to liquid water but is permeable to water vapor. As such, exterior water (such as from a firefighter's water hose) will not penetrate the interior of garment 10, but perspiration from the firefighter can escape. Suitable membranes of this type are distributed by W. L. Gore & Associates under the trademark Gore-Tex.

As described above, the higher lubricity side of lining layer 20 forms an outer surface of liner assembly 14. Thus, the membrane of moisture barrier layer 26 is adhered to the lower lubricity side of lining layer 20. This is advantageous because membranes of this type will generally adhere more readily to a rougher surface than to one which is smooth.

Figure 8:
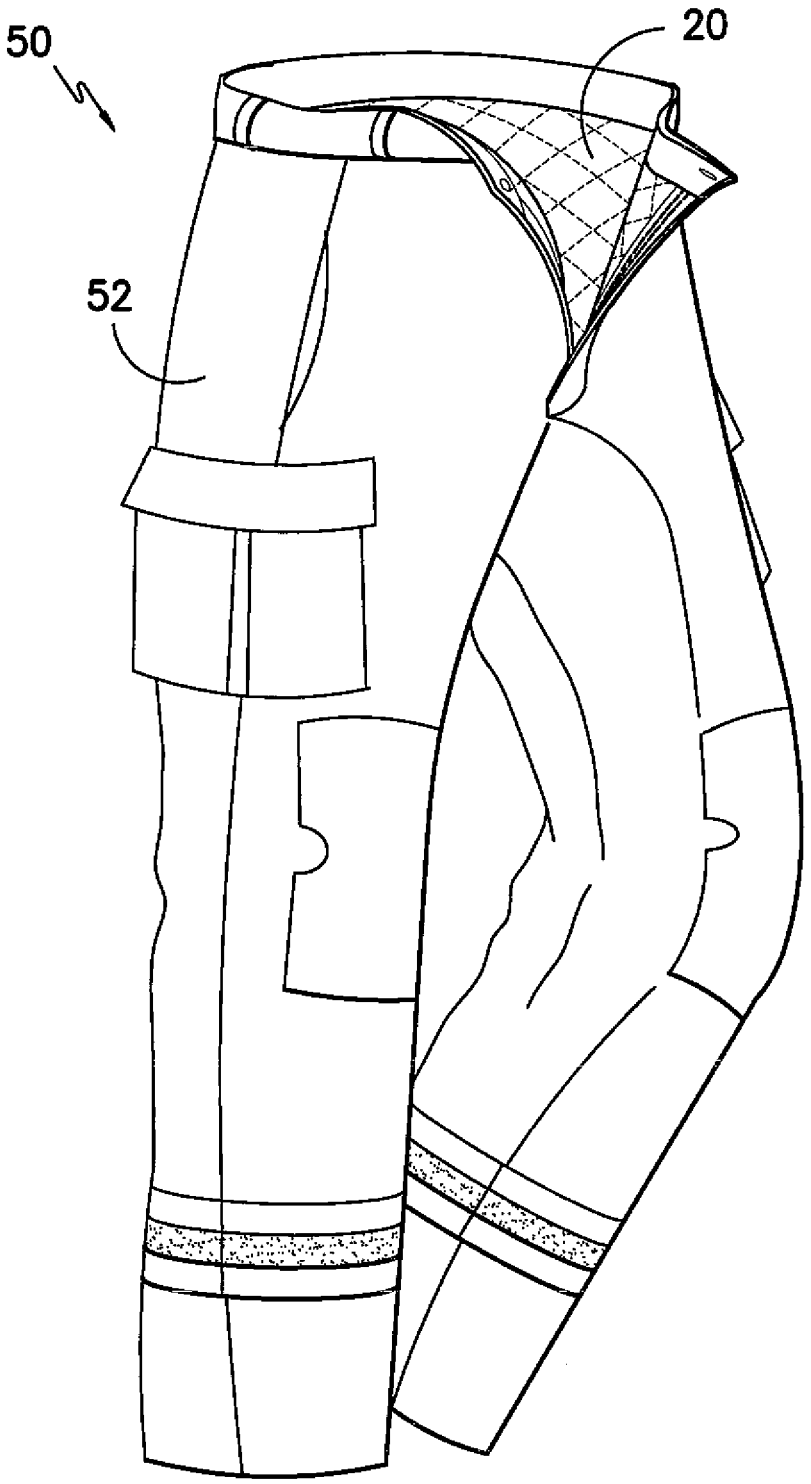
FIG. 8 is a perspective view with cutaway portions of one embodiment of trousers made in accordance with the present disclosure.

In addition to being used in coats and jackets as shown in FIG. 1, the lining layer of the present disclosure may also be used to line other garments. For instance, referring to FIG. 8, a pair of trousers made in accordance with the present disclosure is illustrated. As shown, the trousers 50 include an outer shell 52 similar to the outer shell 12 shown in FIG. 1. In addition, the trousers 50 include a lining layer 20 positioned to be adjacent the wearer's body during use.

Figure 4:
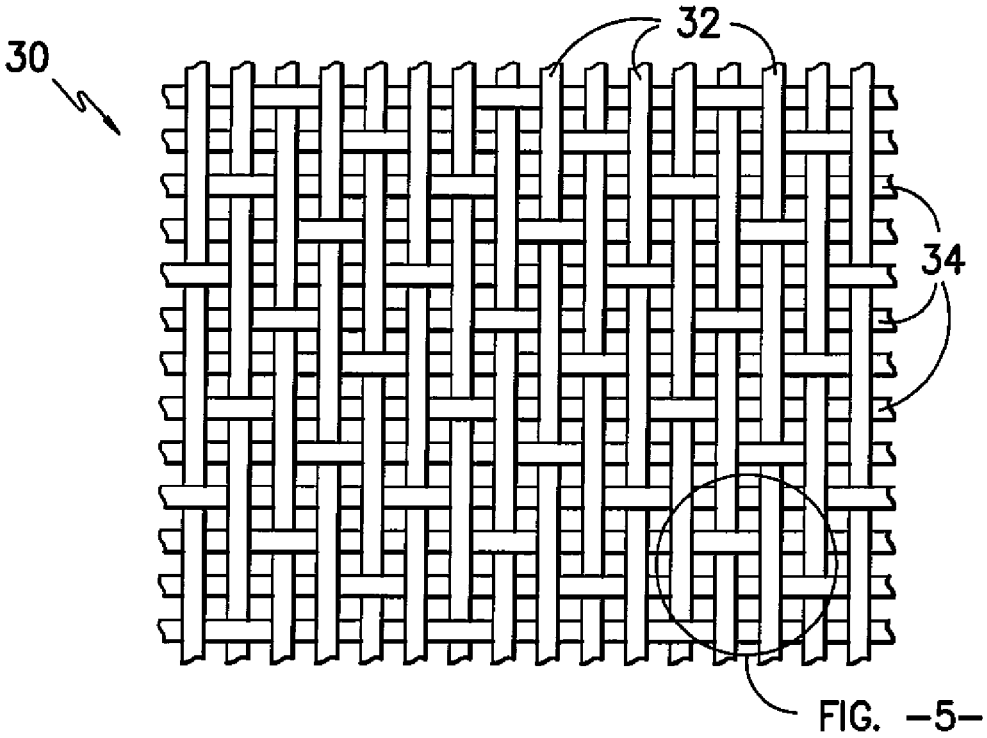
FIG. 4 is an enlarged view of one embodiment of an inner lining made in accordance with the present disclosure.
Figure 5:
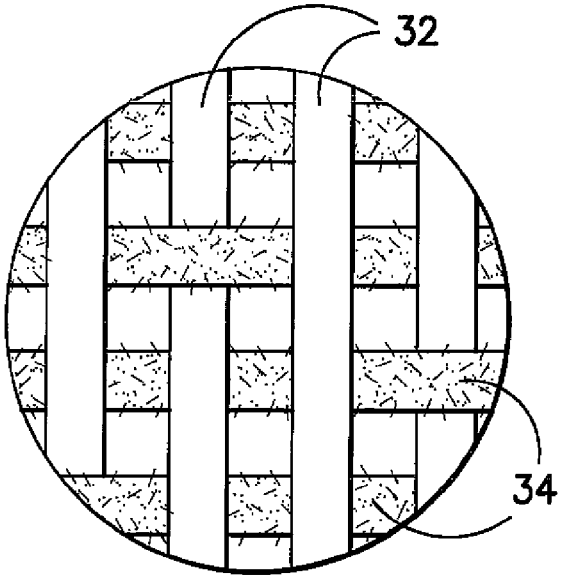
FIG. 5 is an enlarged view of a portion of the fabric illustrated in FIG. 4.

FIGS. 4 and 5 illustrate an improved textile material 30 such as may be used to construct lining layers 20 and 22. As shown, textile material 30 includes a plurality of warp yarns 32 interwoven with a plurality of fill yarns 34. In accordance with the present disclosure, at least one of the warp yarns or the fill yarns is comprised of filament yarns containing para-aramid filaments. The remaining yarns, on the other hand, may comprise spun yarns. The spun yarns can be made from fibers that are inherently flame resistant and/or are fibers treated with a flame retardant composition. In one embodiment, for instance, the warp yarns may comprise the filament yarns, while the fill yarns may comprise the spun yarns. In an alternative embodiment, the fill yarns may comprise the filament yarns, while the warp yarns may comprise the spun yarns. Placing the filament yarns in the warp direction or the fill direction may depend upon the equipment used to produce the fabric and the type of weave.

As described above, at least one set of yarns used to produce the lining layers 20 and 22 is made from para-aramid filaments. The use of para-aramid filament yarns has been found to produce numerous advantages and benefits. For example, the tensile strength of the fabric in the direction parallel to the filament yarns is significantly increased. For example, in the direction of the filament yarns, the fabric can have a tensile strength measured according to ASTM Test D5034 of greater than 400 lbsf, such as greater than 500 lbsf, such as even greater than 600 lbsf. The tensile strength is generally less than 1200 lbsf and can be from about 400 lbsf to about 800 lbsf for a fabric having a basis weight of from about 2 osy to about 6 osy, such as from about 2 osy to about 5 osy, such as from about 2 osy to about 2.5 osy to about 4 osy.

Another unexpected advantage is that the para-aramid filament yarns can be woven without having to be twisted. In the past, similar filament yarns typically had to be twisted so that the yarns could be more easily woven. Filament yarns of the present disclosure, however, can have a minimal amount of twisting without compromising the weaving process. For example, filament yarns can be twisted less than five twists per inch, such as less than four twists per inch, such as even less than three twists per inch. In one embodiment, for instance, the filament yarns may not have any appreciable twisting. By not having to twist the filament yarns, the lubricity of the resulting fabrics can actually be enhanced in certain embodiments.

The use of para-aramid filament yarns may also appreciably increase the flame resistant properties of the fabric in certain embodiments. In fact, it is believed that, in some applications, the flame resistant properties of the fabric are enhanced because the filament yarns are not twisted. For instance, fabrics made in accordance with the present disclosure, even after being laundered five laundry cycles, can have a char length in a direction perpendicular to the filament yarns when tested according to ASTM Test D6413 (AATCC 135) of less than about 50 mm, such as less than about 40 mm, such as even less than about 30 mm. The char length, for instance, can be generally from about 5 mm to about 50 mm. In one particular embodiment, the char length in a direction perpendicular to the filament yarns can be less than about 15 mm.

The weight of the para-aramid filament yarns can vary depending upon the particular application, the desired weight of the fabric, and various other factors. In general, the filament yarns can have a weight of greater than about 100 denier, such as greater than about 140 denier, such as greater than about 180 denier. The denier of the filament yarns is generally less than about 500 denier, such as less than about 400 denier. In one embodiment, the filament yarns have a denier of from about 150 to about 250, such as from about 180 to about 220.

In addition to the filament yarns, the fabric can also include spun yarns. The spun yarns contain flame resistant fibers. In one embodiment, all of the fibers contained in the spun yarns comprise inherently flame resistant fibers, such as meta-aramid fibers.

In one embodiment, the spun yarns may be made from a blend of fibers. For instance, in one embodiment, the spun yarns may comprise meta-aramid fibers blended with para-aramid fibers. For instance, the para-aramid fibers may be present in an amount less than the meta-aramid fibers, such as in an amount less than about 15% by weight, such as from about 1% to about 15% by weight, such as from about 3% to about 10% by weight.

The spun yarns can contain the meta-aramid fibers in an amount greater than about 30% by weight, such as in an amount from about 30% by weight to about 100% by weight. The meta-aramid fibers may be present in the spun yarns in an amount greater than about 40% by weight, such as in an amount greater than 60% by weight, such as in an amount greater than about 80% by weight.

The meta-aramid fibers contained in the spun yarns can be substantially amorphous, crystalline, or a mixture of both. Amorphous meta-aramid fibers generally have a crystallinity of less than about 10%. Crystalline fibers, on the other hand, have a crystallinity greater than about 10%, such as greater than about 25%, such as having a crystallinity of from about 25% to about 40%.

In addition to meta-aramid fibers and/or para-aramid fibers, the spun yarns may contain various other inherently flame resistant fibers. Such fibers may include, for instance, polybenzimidazole fibers, such as poly[2,2'-(m-phenylen)-5, 5'bibenzimidazole].

In addition to inherently flame resistant fibers or instead of inherently flame resistant fibers, the spun yarns may also contain other fibers treated with a flame retardant composition. For instance, in one embodiment, the spun yarns may contain flame resistant cellulose fibers.

As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different sources. FR rayon fibers, for instance, are sold under the name LENZING by Lenzing Fibers of Austria. LENZING FR fibers are viscous fibers that have been treated with a flame retardant composition. In one embodiment, the flame resistant rayon fibers are made by spinning reconstituted cellulose from beech trees. Such fibers are more water absorbent than cotton fibers.

The amount of flame resistant cellulose fibers present in the spun yarns may depend upon various different factors and the particular application. In one embodiment, for instance, the flame resistant cellulose fibers may be present in the spun yarns in an amount from about 20% to about 100% by weight. In one particular embodiment, for instance, the flame resistant cellulose fibers may be present in the spun yarns in an amount from about 30% to about 50% by weight.

As described above, flame resistant cellulose fibers comprise fibers that have been treated with a flame retardant composition. The flame retardant composition can be incorporated into the fibers using various methods and techniques. For instance, the flame retardant composition can be incorporated into the fibers during spinning, can be coated on the fibers, or can be absorbed into the fibers. The flame retardant composition may contain, for instance, a phosphorus compound, a halogen compound, or any other suitable flame resistant agents.

Similar to the filament yarns, the weight of the spun yarns can also vary depending upon the particular application. The spun yarns, for instance, can have a weight of from about 20/1 to about 50/1. For instance, the spun yarns can have a weight of 26/1, 37/1, 40/1, 18/2, or 26/3.

In general, the spun yarns and filament yarns are woven together such that the filament yarns comprise more than about 50% of the surface area of one side of the fabric. For instance, the filament yarns may comprise greater than about 60%, such as greater than about 70%, such as even greater than about 80% of one side of the fabric. The side of the fabric with more exposed filament yarns is then used as the interior face of the garment. The filament yarns provide a fabric with high lubricity characteristics.

In one embodiment, the warp yarns 32 and the fill yarns 34 are woven together using a twill weave. For example, the twill weave may be a 2×1 or a 3×1 weave. Of particular advantage, a twill weave has been found to be more resistant to velcro damage than other weave patterns.

In another embodiment, warp yarns 32 and fill yarns 34 are woven together utilizing a satin weave in order to achieve the desirable qualities discussed above. In a satin weave, the interlacing of each warp yarn is at least one fill yarn apart from the interlacing of either of the two warp yarns next to it. The points of interlacing do not produce an unbroken line (such as with a twill weave), but are scattered about over the weave. The interlacings of the warp yarns are thus hidden by adjacent floats.

As a result of either of the above weaves, warp yarns 32 will mostly appear on one side of textile material 30, whereas fill yarns 34 will mostly appear on the backside thereof. These two sides may be referred to as the warp side and fill side, respectively.

When the warp yarns 32 are multifilament yarns, the warp side will tend to have a lustrous surface of relatively high lubricity. The fill side will have a lesser lubricity, since it is dominated by the spun yarns. The "scattered" interlacings of a satin weave enhance the lubricity difference between the respective sides in relation to what would generally be achieved using, for example, a twill weave.

The construction illustrated in FIGS. 4 and 5 utilizes a particular satin weave referred to as "five shaft" satin. It should be understood that the weave illustrated in FIGS. 4 and 5 is for exemplary purposes only. For example, in other embodiments, a twill weave may be more desirable depending upon the particular application. As a result of the weave illustrated in FIGS. 4 and 5, each warp yarn 32 crosses over four fill yarns 34 before interlacing with the fifth. An adjacent warp yarn 32 has the same interlace pattern, but is offset by two fill yarns 34, as clearly illustrated in FIG. 4.

Figure 6:
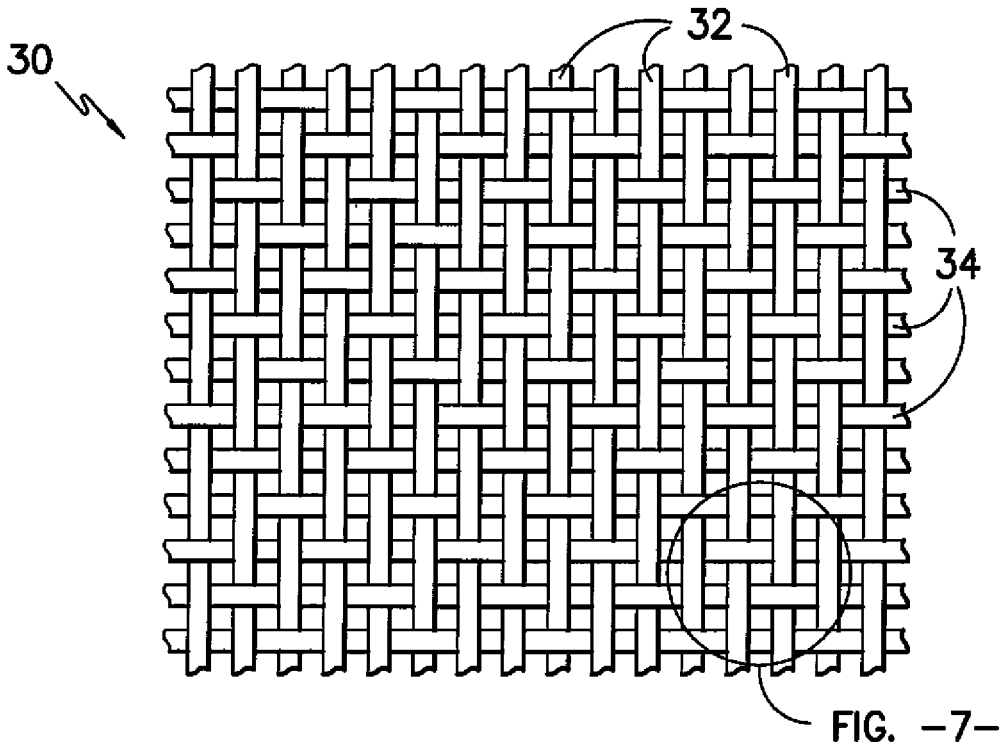
FIG. 6 is another embodiment of an inner lining made in accordance with the present disclosure.
Figure 7:
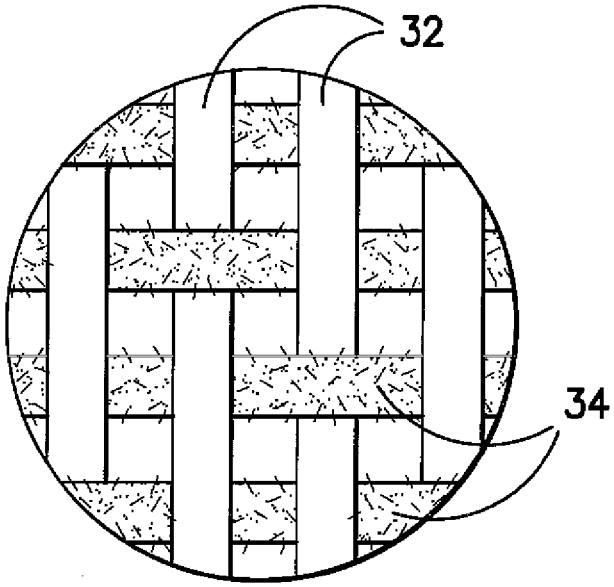
FIG. 7 is an enlarged view of a portion of the fabric illustrated in FIG. 6.

Referring now to FIGS. 6 and 7, an alternative lining fabric 30' is woven together in a twill weave. In certain applications, the twill weave may exhibit durability characteristics that are superior to satin weave fabrics of otherwise similar construction. Like a satin weave, the fill yarns will cross over the warp yarns at predetermined intervals. Unlike a satin weave, however, crossings of adjacent warps will be along diagonal twill lines.

The particular weave utilized in the illustrated case is referred to as a two by one ("2/1" or "2×1") twill. In this weave, the warp passes over two fill yarns before interlacing with the third. The interlacings are offset along the diagonal, as shown, to produce characteristic twill lines. Fabric 30' is preferably produced from multifilament warp yarns 32 and spun fill yarns 34 as described above.

Assuming a square weave and equal yarns in both directions, a five shaft satin will produce a fabric in which about eighty (80) percent of the surface area of the "warp side" will be contributed by the warp yarns. Likewise, about eighty (80) percent of the surface area of the fill side will be contributed by the fill yarns. A 2/1 twill weave will produce a fabric in which about two-thirds of the surface area of the "warp side" will be contributed by the warp yarns. About two-thirds of the fill side's surface area will be contributed by the fill yarns.

An even greater ratio of multifilament to spun surface may be achieved on the warp side if larger yarns are utilized for the warp yarns than are utilized for the fill yarns. Thus, in one embodiment, the filament yarns may have a size or weight greater than the spun yarns. In this regard, the filament yarns may comprise greater than 50% of the overall weight of the fabric, such as greater than about 55%, such as greater than about 60% of the overall weight of the fabric. In other embodiments, however, the spun yarns and filament yarns may be present in relatively equal amounts by weight.

In general, the fabric of the present disclosure may be treated with various finishes. In one particular embodiment, for instance, the fabric may be treated with an anti-odor agent. For instance, the anti-odor agent may comprise metal ions, such as silver ions. The silver ions may act as an antimicrobial agent for reducing odors. In one embodiment, the silver ions may be present in a compound or complex that also absorbs odors. For instance, in one embodiment, the silver ions may be present in a porous zeolite.

In one embodiment, the fabric of the present disclosure may be powder coated with an anti-odor agent. For instance, the anti-odor agent may be in the form of particles having a size of less than about 1 micron, such as from about 0.001 microns to about 1 micron. The anti-odor agent may be combined with a pre-polymer or polymer. The resulting particles may then be heated and applied to the fabric. The polymer or pre-polymer forms an attachment to the surface. The polymer or pre-polymer may comprise a thermoplastic polymer or a thermosetting polymer. The polymer may comprise, for instance, polyester resins, epoxy resins, acrylic resins, phenol resins, melamine resins, urea resins, urethane resins, vinylether resins, and the like. Other polymers include polyamides, polymethylmethacrylate, and polyolefins.

In an alternative embodiment, the anti-odor agent may be contained in a finish that is then applied to the fabric. The finish may include binders, leveling agents, adherents, thickeners, and the like. For instance, in one embodiment, a binder, such as a polyurethane or an acrylic-type resin may be combined with the anti-odor agent and applied to the fabric as a liquid. Once applied, the fabric may be dried.

The present disclosure may be better understood with reference to the following examples.

EXAMPLES

The following fabrics were produced and tested for various properties. As will be demonstrated below, fabrics containing filament yarns made from para-aramid filaments demonstrated better strength characteristics and better flame resistance without in any way compromising lubricity.

Example No. 1

Warp Yarn: 200 denier meta-aramid multifilament yarn with 5 twists per inch
Fill Yarn: 40/1 spun yarn containing meta-aramid fibers
Ends: 82 per inch
Picks: 74 per inch
Weight: 3.68
Weave: 2×1 twill weave

Example No. 2

Warp Yarn: 200 denier para-aramid multifilament yarn with about 4 twists per inch Fill Yarn: 40/1 spun yarn containing meta-aramid fibers, 23.1 twists per inch
Ends: 82 per inch
Picks: 74 per inch
Weight: 3.68 osy
Weave: 2×1 twill weave Example No. 3

Warp Yarn: 200 denier para-aramid multifilament yarn with 5 twists per inch
Fill Yarn: 37/1 spun yarn containing meta-aramid fibers, 22.26 twists per inch
Ends: 82 per inch
Picks: 74 per inch
Weight: 3.72 osy
Weave: 2×1 twill weave Example No. 4

Warp Yarn: 200 denier para-aramid multifilament yarn with no twists per inch
Fill Yarn: 30/1 spun yarn containing 65% meta-aramid fibers and 35% by weight FR cellulose fibers
Ends: 82 per inch
Picks: 62 per inch
Weight: 3.77 osy
Weave: 2×1 twill weave The above fabrics were then tested for various properties relating to strength and flame resistance. The following results were obtained:

As shown above, the use of para-aramid filament yarns dramatically increased the tensile strength of the fabric in the direction parallel to the filament yarns. The flame resistant properties of the fabric were also dramatically improved in a direction perpendicular to the filament yarns.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A protective garment comprising:

a garment being in the form of a coat or trousers;

the garment including an outer shell having an exterior surface and an inside surface; and the garment including an inner lining positioned on the inside surface of the outer shell, the inner lining comprising a woven fabric having spun yarns and filament yarns, the inner lining having an interior surface configured to be positioned to face a wearer and an opposite outside surface, the interior surface having greater lubricity than the outside surface, the spun yarns containing flame resistant fibers, the flame resistant fibers comprising para-aramid fibers blended with flame resistant cellulose fibers, the filament yarns are para-aramid filaments, the filament yarns having less than five twists

| TEST_METHOD | TEST_NAME | UNIT | Example No. 1 0401 2011 | Example No. 2 0401 2008 | Example No. 3 0401 2008 | Example No. 4 0401 2011 |
|---|---|---|---|---|---|---|
| AATCC 135 | SHRINK FILL 5X | PERCENT | 3.3 | 5.3 | 4.5 | 3.3 |
| | SHRINK WARP 5X | PERCENT | 0.0 | 0.4 | 0.4 | 0.0 |
| ASTM D 1777 | THICKNESS | INCHES | 0.009 | 0.010 | 0.009 | 0.009 |
| ASTM D 3774 | WIDTH | INCHES | 61.45 | 61.75 | 61.78 | 61.00 |
| ASTM D 3775 | ENDS | THRDS_IN | 81 | 83 | 81 | 84 |
| | PICKS | THRDS_IN | 73 | 73 | 72 | 52 |
| ASTM D 3776 | WEIGHT | OZ_SQ_YD | 3.54 | 3.44 | 3.50 | 3.74 |
| ASTM D 3786 | MULLEN BURST NET | PSI | 228 | 160 | 250 | 285 |
| ASTM D 5034 | BREAK STRENGTH FILL | POUNDS | 117 | 131 | 151 | 62 |
| | BREAK STRENGTH WARP | POUNDS | 306 | 679 | 677 | 440 |
| ASTM D 5587 | TRAP TEAR FILL | POUNDS | 34 | 27 | 36 | 16 |
| | TRAP TEAR WARP | POUNDS | 100 | 96 | 67 | 65 |
| ASTM D 6413 | AFTER FLAME FILL | SECONDS | 0 | 0 | 0 | 0 |
| | AFTER FLAME WARP | SECONDS | 0 | 0 | 0 | 0 |
| | AFTER GLOW FILL | SECONDS | 3 | 5 | 4 | 1 |
| | AFTER GLOW WARP | SECONDS | 3 | 4 | 5 | 2 |
| | CHAR LENGTH FILL | MM | 57 | 19 | 24 | 15 |
| | CHAR LENGTH WARP | MM | 57 | 51 | 62 | 37 |
| | DRIP FILL | NONE | 0 | 0 | 0 | 0 |
| | DRIP WARP | NONE | 0 | 0 | 0 | 0 |
| ASTM D 6413 (AATCC 135) | AFTER FLAME FILL 5X | SECONDS | 0 | 0 | 0 | 0 |
| | AFTER FLAME WARP 5X | SECONDS | 0 | 0 | 0 | 0 |
| | AFTER GLOW FILL 5X | SECONDS | 3 | 6 | 5 | 1 |
| | AFTER GLOW WARP 5X | SECONDS | 3 | 5 | 5 | 2 |
| | CHAR LENGTH FILL 5X | MM | 56 | 25 | 28 | 14 |
| | CHAR LENGTH WARP 5X | MM | 53 | 63 | 69 | 43 |
| | DRIP FILL 5X | NONE | 0 | 0 | 0 | 0 |
| | DRIP WARP 5X | NONE | 1 | 0 | 0 | 0 |
| ASTM D 737 | AIR PERMEABILITY | CFM | 72 | 52 | 56 | 85 |
| NFPA 1971 8.6 | SHRINK FILL 5MN 500F | PERCENT | 0.5 | 1.0 | 1.8 | 0.0 |
| | SHRINK WARP 5MN 500F | PERCENT | 0.1 | 0.3 | 0.3 | 0.0 |

per inch, the filament yarns occupying a greater surface area than the spun yarns on the interior surface, the fabric having a tensile strength in at least one direction according to ASTM Test D5034 of greater than or equal to 400 pounds per foot$^2$ (lbsf), the woven fabric of the inner lining having a basis weight of from 2 to 5 ounces per yard$^2$ (osy), the woven fabric including warp yarns and fill yarns, and being constructed such that either:

(a) all of the warp yarns are the filament yarns and all of the fill yarns are the spun yarns; or (b) all of the warp yarns are the spun yarns and all of the fill yarns are the filament yarns.

2. A protective garment as defined in claim 1, wherein the filament yarns have a denier of from 100 to 400.

3. A protective garment as defined in claim 2, wherein the inner lining has a weight of from 2 osy to less than 4 osy, the filament yarns being multi-filament yarns and having less than 3 twists per inch.

4. A protective garment as defined in claim 1, wherein the filament yarns have less than or equal to three twists per inch.

5. A protective garment as defined in claim 1, wherein the filament yarns have less than or equal to one twist per inch.

6. A protective garment as defined in claim 1, wherein the para-aramid fibers are present in the spun yarns in an amount of greater than 80% by weight.

7. A protective garment as defined in claim 1, wherein the filament yarns are multifilament yarns.

8. A protective garment as defined in claim 1, wherein the inner lining has a weight of from 2 osy to less than 4 osy.

9. A protective garment as defined in claim 1, wherein all of the warp yarns are spun yarns and all of the fill yarns are multifilament yarns.

10. A protective garment as defined in claim 1, wherein all of the warp yarns are multifilament yarns and all of the fill yarns are spun yarns.

11. A protective garment as defined in claim 1, wherein the woven fabric of the inner lining has a twill weave.

12. A protective garment as defined in claim 1, wherein the woven fabric that comprises the inner lining has a char length of less than or equal to 40 mm in at least one direction when tested according to ASTM Test D6413 and after being subjected to five laundry cycles.

13. A protective garment as defined in claim 1, wherein the woven fabric of the inner lining has a tensile strength greater than or equal to 600 lbsf.

14. A protective garment as defined in claim 1, wherein the woven fabric of the inner lining has from 70 to 90 ends per inch and from 60 to 80 picks per inch.

15. A protective garment as defined in claim 1, further comprising a moisture barrier layer located adjacent the outside surface of the inner lining.

16. A protective garment as defined in claim 1, further comprising a felt layer located between the outer shell and the inner lining.

17. A protective garment as defined in claim 1, wherein the woven fabric of the inner lining includes an anti-odor agent.

18. A protective garment as defined in claim 17, wherein the anti-odor agent comprises a silver zeolite.

19. A protective garment as defined in claim 1, wherein the para-aramid fibers are present in the spun yarns in an amount greater than 60% by weight.

20. A protective garment as defined in claim 1, wherein the spun yarns further comprise meta-aramid fibers.

21. A protective garment as defined in claim 1, wherein the flame resistant cellulose fibers comprise flame resistant rayon fibers.

22. A protective garment as defined in claim 1, wherein the flame resistant cellulose fibers are present in the spun yarns in an amount from 20% to 50% by weight.

23. A protective garment as defined in claim 1, wherein the inner lining has an air permeability of at least 85 CFM according to ASTM Test D737.

24. A protective garment comprising:

a garment being in the form of a coat or trousers;

the garment including an outer shell having an exterior surface and an inside surface; and the garment including an inner lining positioned on the inside surface of the outer shell, the inner lining consisting of a woven fabric having spun yarns and filament yarns, the inner lining having an interior surface configured to be positioned to face a wearer and an opposite outside surface, the interior surface having greater lubricity than the outside surface, the spun yarns containing flame resistant fibers, the flame resistant fibers comprising para-aramid fibers blended with flame resistant cellulose fibers, the filament yarns are para-aramid filaments, the filament yarns occupying a greater surface area than the spun yarns on the interior surface, the fabric having a tensile strength in at least one direction according to ASTM Test D5034 of greater than or equal to 400 pounds per foot$^2$ (lbsf), the woven fabric of the inner lining having a basis weight of from 2 to 5 ounces per yard$^2$ (osy), the woven fabric including warp yarns and fill yarns, and being constructed such that either:

(a) all of the warp yarns are the filament yarns and all of the fill yarns are the spun yarns; or (b) all of the warp yarns are the spun yarns and all of the fill yarns are the filament yarns.

* * * * *